US006895195B2

(12) United States Patent
Katamoto

(10) Patent No.: US 6,895,195 B2
(45) Date of Patent: May 17, 2005

(54) IMAGE PROCESSING SYSTEM AND METHOD FOR RECORDING IMAGE ACCORDING TO FEATURE/TYPE OF THE RECORDING MEMBER

(75) Inventor: Kohji Katamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 9 days.

(21) Appl. No.: 10/402,020

(22) Filed: Mar. 28, 2003

(65) Prior Publication Data

US 2003/0202808 A1 Oct. 30, 2003

(30) Foreign Application Priority Data

Apr. 24, 2002 (JP) ..... 2002-122391

(51) Int. Cl.[7] ..... G03G 15/00
(52) U.S. Cl. ..... 399/45; 399/81; 399/82
(58) Field of Search ..... 399/45, 81, 82, 399/182, 183, 186–188, 196

(56) References Cited

U.S. PATENT DOCUMENTS 5,333,039 A * 7/1994 Sagara ..... 399/188
5,497,217 A * 3/1996 Yoshida ..... 399/182
5,600,412 A * 2/1997 Connors ..... 399/81

FOREIGN PATENT DOCUMENTS

JP 03-232373 10/1991
JP 10-337886 12/1998

* cited by examiner

*Primary Examiner*—William J. Royer
(74) *Attorney, Agent, or Firm*—Renner, Otto, Boisselle & Sklar, LLP

(57) ABSTRACT

An image processing system includes an image forming device 100 and an image transmission device 101. The image transmission device 101 is equipped with a driver 104 enabling formation of an image to a whole area of a recording member according to a marginless printing mode of the image forming device 100 corresponding to a feature/type of the recording member. The driver 104 of the image transmission device 101 is capable of forming the image to the whole area of the recording member in the marginless printing mode of the image forming device 100 according to the feature/type of the recording member. This is effective in recording the image on the whole area of the recording member having a specific feature/type, such as a thick paper, an OHP sheet, an envelope, a special paper, a postcard, or a business card.

6 Claims, 4 Drawing Sheets

IMAGE PROCESSING SYSTEM AND METHOD FOR RECORDING IMAGE ACCORDING TO FEATURE/TYPE OF THE RECORDING MEMBER

BACKGROUND OF THE INVENTION

The present invention relates to an image processing system comprising an image forming device for forming an image on a recording member and an image transmission device for transmitting image data to the image forming device. In particular, the present invention relates to an image processing system and a method for recording an image equipped with a function of forming an image based on a printing mode in which an image is not formed to a portion of the recording member and a function of forming an image based on a printing mode in which an image is formed to the whole area of the recording member, according to which image forming to the whole area of the recording member is made possible according to a feature/type of the recording member on which an image is to be recorded.

DESCRIPTION OF THE RELATED ART

According to an image forming device adopting an electrophotographic process, a toner image being formed on the surf ace of a recording paper (recording member) is fixed to the recording paper by heat, and then the recording paper is ejected to the outside of the device.

According to this system, the toner image formed on the recording paper must be passed through a pair of heating and fixing rollers disposed within a fixing device to be fixed to the recording paper.

However, there is a drawback according to this system in that the recording paper sometimes adheres to the fixing roller by the heated toner (developing agent), causing abnormal transfer of the recording paper.

Japanese Patent Laid-Open No. 3-232373 discloses a conventional image forming device adopting an electrophotographic process, wherein a region in which no image is formed is provided to the front end of the recording paper in the transfer direction, so as to prevent the recording paper from being adhered to (wound around) the fixing roller.

However, there is growing demand for recording images to a wide variety of recording papers, and to correspond to this demand, those in the field are developing ways to enable images to be reproduced on various types of recording papers.

In recent days, many electronic devices such as digital cameras have become commercially available, by which the image data being handled has become multicolored, and the quality of the image advanced.

Thus, there is an increasing demand in the market for reproducing the colored image more truly and effectively.

The inkjet printer industry responds to this demand by providing products capable of marginless printing according to which images can be recorded on the whole area of the recording paper.

Japanese Patent Laid-Open No. 10-337886 discloses such a device.

On the other hand, multicolor is also a trend in the field of image forming devices (copying machines) adopting the electrophotographic process, and in recent days, color copy service is available even in convenience stores.

Also in the present field, there is a demand for the images to be recorded and reproduced on the recording paper in a more true and effective manner.

SUMMARY OF THE INVENTION

Therefore, the present invention aims at solving the above-mentioned problems of the prior art. The object of the invention is to provide an image processing system capable of reproducing an image on a whole area of a recording member having a specific feature (of a specific type) such as thick paper, OHP sheets, envelopes, special paper, postcards and business cards. It is considered that the users have a strong demand for a means to reproduce images in a true and effective manner on such specific recording members.

Moreover, the object of the present invention is to provide a method for recording an image on the whole area of a recording member having a specific feature (of a specific type) utilizing an image forming device adopting an electrophotographic process, comprising the steps of reproducing an image on the whole area of the recording member having a specific feature (of a specific type), and fixing the image formed on the whole area of the recording member.

The image processing system of the present invention comprises an image forming device for forming an image on a recording member, and an image transmission device connected to the image forming device for transmitting image data to the image forming device, wherein the image forming device comprises a function for forming the image according to a first image forming mode in which the image is formed to a whole area of a recording member, and a function for forming the image according to a second image forming mode in which the image is formed to a normal area of the recording member excluding a specific area thereof; and the image transmission device comprises an image forming control unit that enables the image to be formed on the whole area of the recording member based on the first image forming mode of the image forming device according to a feature/type of the recording member used to record the image.

In the above structure, the image forming control unit of the image transmission device enables the image to be formed on the whole area of the recording member based on the first image forming mode of the image forming device, according to the feature/type of the recording member being used to record the image.

According to another aspect of the present image processing system, the image transmission device comprises a recording member selecting unit for selecting the recording member for recording the image, and an image forming mode control unit for enabling the first image forming mode of the image forming device in which the image is formed to the whole area of the recording member to be selectable according to the feature/type of the recording member being selected via the recording member selecting unit.

When the user selects the recording member for recording the image through the recording member selecting unit of the image transmission device, the image forming mode control unit of the image transmission device makes the first image forming mode of the image forming device in which an image is recorded to the whole area of the recording member selectable only when the feature/type of the selected recording member is suitable for forming the image on the whole area of the recording member.

According to another aspect of the present image processing system, the image transmission device comprises an image forming mode selecting unit for selecting either the first image forming mode or the second image forming mode of the image forming device, and a recording member determining unit for determining the recording members capable of being selected by the recording member selecting unit according to the first image forming mode or the second image forming mode of the image forming device selected by the image forming mode selecting unit.

When the user selects either the first image forming mode or the second image forming mode through the image forming mode selecting unit of the image transmission device, the recording member determining unit of the image transmission device determines the recording members suited for either the first image forming mode or the second image forming mode based on the selected image forming mode.

According to one aspect of the present image processing system, the feature/type of the recording member is the thickness of the recording member body.

The recording members capable of being subjected to whole area image forming include thick paper which is thicker than normal paper, OHP sheets, envelopes, special papers, postcards, and business cards.

According to another aspect of the present image processing system, the image forming device comprises a function of suppressing a concentration of the image formed to the predetermined area at a rim portion of the recording member than the concentration of the image formed to the normal area of the recording member excluding the predetermined area at the rim portion thereof, when forming the image to the whole area of the recording member of the specific feature/type according to the first image forming mode.

When the image is formed to the whole area of the recording member of the specific feature/type according to the first image forming mode of the image forming device, the concentration of the image formed to the predetermined area at the rim of the recording member is suppressed more than the concentration of the image formed to the normal area of the recording member.

According to the present invention, the method for recording an image to a whole area of a recording member of a specific feature/type adopting an electrophotographic process comprises an image reproducing step of reproducing the image on the whole area of the recording member of the specific feature/type; and an image fixing step of fixing the image reproduced on the whole area of the recording member of the specific feature/type.

The method enables images to be recorded on the whole area of the recording member having the specific feature utilizing an image forming device equipped with a fixing device utilizing an electrophotographic process, the method comprising an image reproducing step of reproducing the image on the whole area of the recording member having the specific feature, and an image fixing step of fixing the image being reproduced on the recording member having the specific feature.

DETAILED DESCRIPTION OF THE PREFERRED EMBODIMENTS

One preferred embodiment of the present invention will now be explained in detail with reference to the accompanying drawings.

Figure 1:
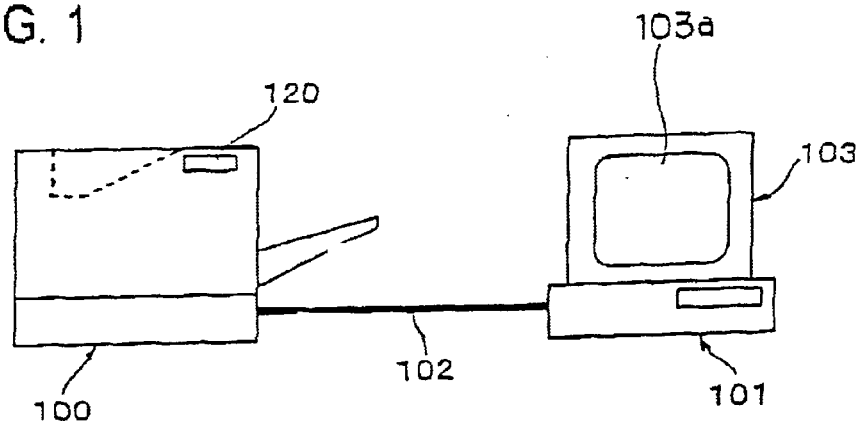
FIG. 1 is a view showing the connecting configuration of an image processing system according to the preferred embodiment of the invention.

FIG. 1 shows a connecting configuration of an image processing system according to the preferred embodiment of the present invention.

As shown in FIG. 1, the image processing system according to the present invention comprises an image forming device 100 for forming an image on a recording member, and an image transmission device 101 connected to the image forming device 100 for transmitting image data to the image forming device 100.

According to the image processing system of the present embodiment, the image forming device 100 is equipped with a function of performing image formation according to a marginless printing mode (a first image forming mode) in which an image is formed to the whole area of the recording member, and a function of performing image formation according to a normal printing mode (a second image forming mode) in which an image is formed within a normal printing area excluding a predetermined area of the recording member.

According to the present image processing system, the image transmission device 101 is equipped with a driver 104 which is an image forming mode control means enabling an image to be formed to the whole area of the recording member according to the marginless printing mode of the image forming device 100, in correspondence to the feature/type (hereinafter referred to as feature) of the recording member being used to record the image.

As shown in FIG. 1, the present image processing system comprises an image forming device 100 and an image transmission device 101, such as a PC (personal computer), for transmitting the image data to the image forming device 100. The image forming device 100 and the image transmission device 101 are connected via a connecting cable 102, and image data is transmitted from the image transmission device 101 via a communication path such as a connecting cable 102 to the image forming device 100.

Furthermore, the image forming device 100 of the present image processing system comprises an operating panel 120 which functions as an operating unit for setting up various configurations, and the image transmission device 101 of the present image processing system comprises a display 103 functioning as a display unit for displaying the operation directing screen enabling determination of various configurations.

Figure 4:
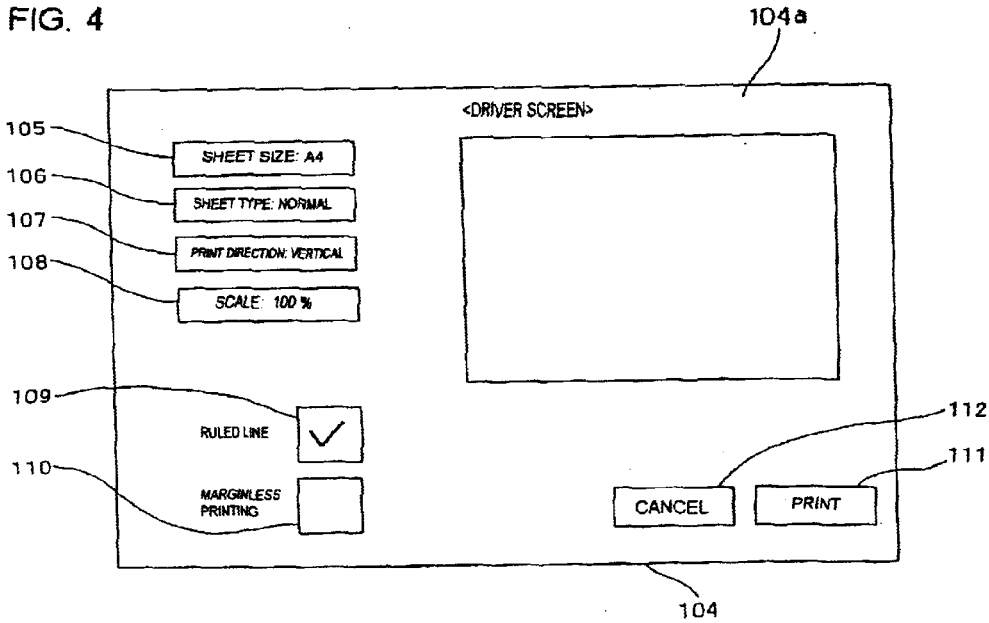
FIG. 4 is a detailed view showing the operation indicating screen of an image transmission device of the image processing system according to the preferred embodiment of the invention.

When transmitting image data from the image transmission device 101 to the image forming device 100 of the image processing system, a display screen 103*a* of the display 103 of the image transmission device 101 comprises, as shown in FIG. 4, a window of a driver screen 104*a* of the driver 104 (the operation directing screen) including operation directing keys for setting up various conditions for transmitting image data and a button key for starting transmission of the data. The transmission of image data is executed through the driver 104 displayed as a window on the display screen 103*a* of the display 103 of the image transmission device 101.

According to the image processing system of the present invention, the image transmission device 101 comprises a "paper type" key 106 functioning as a recording member selecting means for selecting the member for recording the image, and the driver 104 functioning as an image forming mode control means that enables a user to select a marginless printing mode of the image forming device 100 according to which an image is formed to the whole area of the recording member, based on the feature of the recording member selected through the "paper type" key 106.

The image transmission device 101 of the present image processing system comprises a "marginless printing" check box 110 for a marginless printing function as an image forming mode selecting means for selecting either the marginless printing mode or the normal printing mode of the image forming device 100, and a "paper type" key 106 comprising a "normal paper" key 113, a "thick paper" key 114, an "OHP" key 115, an "envelope" key 116, and a "special paper" key 117 which are recording member determining means for determining the selectable recording member.

According to the present image processing system, the feature of a recording member is the thickness of the recording member body.

Further according to the present image processing system, upon forming an image to the whole area of the recording member having a specific feature in the marginless printing mode, the image forming device 100 comprises a function of suppressing the density of the image formed to a predetermined area in the rim (edge portion) of the recording member compared to the density of the image formed to the normal area excluding the predetermined area on the frame portion of the recording member.

A method for recording an image according to the present invention relates to a method for recording an image to a whole area of a recording member having a specific feature utilizing an electrophotographic process, comprising an image reproducing process for reproducing an image on the whole area of the recording member having a specific feature, and an image fixing step for fixing the image being reproduced on the whole area of the recording member having the specific feature.

Figure 2:
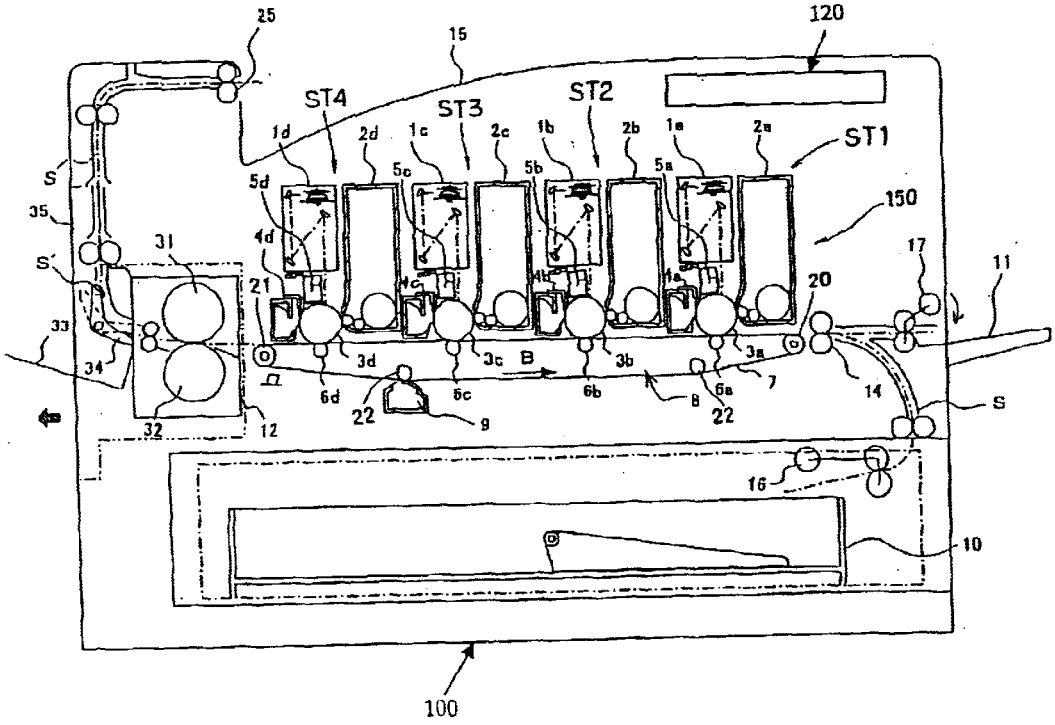
FIG. 2 is an explanatory view showing the structure of an image forming device in the image processing system according to the preferred embodiment of the invention.

FIG. 2 is an explanatory view showing the structure of the image forming device 100 of the image processing system according to a preferred embodiment of the present invention.

As shown in FIG. 2, the image forming device 100 of the present image processing system comprises an image forming unit 150 for forming an image on a recording member based on the image data being transmitted from the image transmission device 101, and a fixing unit 12 which is an image fixing means for fixing the image formed on the recording member.

The image forming device 100 of the present image processing system forms a multi-colored or monochrome image (toner image) on a predetermined sheet (recording paper) being a recording member based on the image data being received from an outside image transmission device 101.

Further, as shown in FIG. 2, the image forming device 100 comprises exposure units 1*a*, 1*b*, 1*c* and 1*d*, developers 2*a*, 2*b*, 2*c* and 2*d*, photosensitive drums 3*a*, 3*b*, 3*c* and 3*d*, cleaner units 4*a*, 4*b*, 4*c* and 4*d*, chargers 5*a*, 5*b*, 5*c* and 5*d*, a transfer belt unit 8, a transfer belt cleaning unit 9, the fixing unit 12, a paper transfer path S, a paper feed tray (cassette) 10, a manual paper feed tray 11, and eject trays 15 and 33.

The operating panel 120 for determining various settings is equipped to the body of the image forming device 100.

The image data being treated by the image forming device 100 of the present image processing system corresponds to a colored image utilizing the following colors: black (K), cyan (C), magenta (M) and yellow (Y).

Accordingly, four exposure units 1*a*, 1*b*, 1*c* and 1*d*, four developers 2*a*, 2*b*, 2*c* and 2*d*, four photosensitive drums 3*a*, 3*b*, 3*c* and 3*d*, four cleaner units 4*a*, 4*b*, 4*c* and 4*d*, and four chargers 5*a*, 5*b*, 5*c* and 5*d* are provided to create four kinds of latent images corresponding to the four colors, wherein a corresponds to black, b corresponds to cyan, c corresponds to magenta, and d corresponds to yellow, by which four image stations ST1, ST2, ST3 and ST4 are constituted.

As shown in FIG. 2, the photosensitive drums 3*a*, 3*b*, 3*c* and 3*d* are arranged (equipped) near the substantial center of the body of the image forming device 100.

The chargers 5*a*, 5*b*, 5*c* and 5*d* are charging means for evenly charging the surface of the photosensitive drums 3*a*, 3*b*, 3*c* and 3*d* to a determined potential, and any type of means such as the one shown in FIG. 2, a contact roller type charger or a brush type charger can be used.

The exposure units 1*a*, 1*b*, 1*c* and 1*d* can utilize a write head comprising light emitting elements such as EL (electroluminescence) and LED (light emitting diode) arranged in arrays, or a laser scanning unit (LSU) comprising a laser radiation unit and mirrors as shown in FIG. 2.

The surface of the evenly charged photosensitive drums 3*a*, 3*b*, 3*c* and 3*d* are exposed using the exposure units 1*a*, 1*b*, 1*c* and 1*d* according to the image data being input, by which static latent images corresponding to the image data are formed on the surface of photosensitive drums 3*a*, 3*b*, 3*c* and 3*d*.

The developers 2*a*, 2*b*, 2*c* and 2*d* are for manifesting the electrostatic latent images formed on the surface of the photosensitive drums 3*a*, 3*b*, 3*c* and 3*d* using toners (developing agent) having colors (K, C, M, Y).

The cleaner units 4*a*, 4*b*, 4*c* and 4*d* are for removing and collecting the toner remaining on the surface of the photosensitive drums 3*a*, 3*b*, 3*c* and 3*d* after the images are developed and transferred.

The transfer belt unit 8 disposed below the photosensitive drums 3*a*, 3*b*, 3*c* and 3*d* is equipped with a transfer belt 7, a transfer belt drive roller 20, a transfer belt driven roller 21, a plurality of transfer belt tension rollers 22, and transfer rollers 6*a*, 6*b*, 6*c* and 6*d*.

The transfer belt drive roller 20, the transfer belt driven roller 21 and the transfer belt tension rollers 22 of the transfer belt unit 8 are for pulling and supporting the transfer belt 7 and to drive the transfer belt 7 in the arrow B direction of FIG. 2.

The transfer rollers 6*a*, 6*b*, 6*c* and 6*d* of the transfer belt unit 8 are rotatably supported by the inside frame (not shown) of the transfer belt unit 8, which hold the transfer belt 7 in a tensioned manner together with the transfer belt drive roller 20, the transfer belt driven roller 21 and the transfer belt tension rollers 22.

The transfer rollers 6*a*, 6*b*, 6*c* and 6*d* of the transfer belt unit 8 transfer the toner images formed on the surface of the photosensitive drums 3*a*, 3*b*, 3*c* and 3*d* onto a sheet (recording paper) that is adhered to and transferred on the transfer belt 7.

The transfer belt 7 of the transfer belt unit 8 is disposed so that it comes into contact with the surfaces of the photosensitive drums 3*a*, 3*b*, 3*c* and 3*d*.

By transferring toner images of each color formed on the surfaces of photosensitive drums 3*a*, 3*b*, 3*c* and 3*d* onto the sheet (recording paper) in sequential manner, a colored toner image (multicolor toner image) is created.

The transfer belt 7 of the transfer belt unit 8 is formed of a film having a thickness of about 100 $\mu$m and in an endless shape.

The transfer of the toner images from the photosensitive drums 3*a*, 3*b*, 3*c* and 3*d* to the sheet (recording paper) are performed by transfer rollers 6*a*, 6*b*, 6*d* and 6*d* coming into contact with the back side of the transfer belt 7 of the transfer belt unit 8.

A high voltage (high voltage having reverse polarity (+) to the charged polarity (−) of the toner) is applied to the transfer rollers 6*a*, 6*b*, 6*c* and 6*d* of the transfer belt unit 8 so as to transfer the toner images to the sheet (recording paper).

The transfer rollers 6*a*, 6*b*, 6*c* and 6*d* of the transfer belt unit 8 are rollers having a metallic axis formed for example of stainless steel with a diameter of 8 to 10 mm as a base and a conductive elastic material such as an EPDM (ethylene propylene dienomethy rubber) or an urethane foam covering the base.

This conductive elastic member enables high voltage to be applied evenly to the sheet (recording paper).

According to the present embodiment, brushes or the like can be used in place of the transfer rollers 6*a*, 6*b*, 6*c* and 6*c* as transfer electrodes.

As shown in FIG. 2, the transfer belt cleaning unit 9 is disposed below the transfer belt unit 8.

Moreover, the toner adhered to the transfer belt 7 by the transfer belt 7 coming into contact with the photosensitive drums 3*a*, 3*b*, 3*c* and 3*d* causes the back surface of the sheet (recording paper) to be stained, so it is removed and collected by the transfer belt cleaning unit 9.

The paper feed tray (cassette) 10 is a tray for storing the sheets (recording paper) used for forming images, which is disposed below the image forming portion 150 of the image forming-device 100 of the present image processing system.

Further, the manual paper feed tray 11 is disposed on the right side of the body of the image forming device 100 as shown in FIG. 2. The manual paper feed tray 11 allows a plural number of sheets (recording paper) or sheets such as thick paper, OHP (overhead projector) sheets, envelopes and special paper that cannot be filled in the paper feed tray (cassette) to be supplied to the recording unit in a simple manner.

As shown in FIG. 2, the sheet eject tray 15 is disposed on the upper side of the body of the image forming device 100 of the present image, processing system, the eject tray 15 being a tray for receiving the printed sheets face-down.

As shown in FIG. 2, the sheet eject tray 33 is disposed on the left side of the body of the image forming device 100 of the present image processing system, the eject tray 33 being a tray for receiving the printed sheets face-up.

Moreover, the image forming device 100 of the present image processing system comprises an S-shaped paper transfer path S for transferring the sheet (recording paper) from the paper feed tray (cassette) 10 via the transfer belt unit 8 and the fixing unit 12 to the eject tray 15.

To the area approximate the paper transfer path S extending from the paper feed tray (cassette) 10 to the eject tray 15 and the eject tray 33 are disposed pickup rollers 16 and 17, a resist roller 14, the fixing unit 12, a transfer direction switching gate 34, and a transfer roller 25.

The transfer roller 25 is a small roller for aiding and supporting the transfer of the sheet (recording paper), and a plurality of transfer rollers 25 are disposed along the paper transfer path S.

Pickup rollers 16 and 17 are disposed to the end portions of the paper feed tray (cassette) 10 and the manual paper feed tray 11, and function as rollers for taking one sheet (recording paper) from the paper feed tray (cassette) 10 and the manual paper feed tray 11 (recording paper) at a time and supplying the same to the paper transfer path S.

The transfer direction switching gate 34 is disposed rotatably on a side cover 35, and by the rotation of the transfer direction switching gate 34 from a state shown by the solid line of FIG. 2 to the position shown by the broken line of FIG. 2, the sheet (recording paper) can be redirected midway along the paper transfer path S and discharged on the eject tray 33.

When the transfer direction switching gate 34 is positioned as shown by the solid line of FIG. 2, the sheet passes through a transfer portion S' (a portion of paper transfer path S) formed between the fixing unit 12, the side cover 35 and the transfer direction switching gate 34, and ejected on the eject tray 15.

The resist roller 14 is for correcting the obliqueness of the sheet by regulating the front end of the sheet being transferred on the paper transfer path S, and for controlling the timing of the movement with the front end of the images (toner images) being reproduced on the surfaces of the photosensitive drums 3*a*, 3*b*, 3*c* and 3*d*.

The resist roller 14 functions to transfer the sheet at a desired timing corresponding to the rotation of the photosensitive drums 3*a*, 3*b*, 3*c* and 3*d* so that the multiple transfer of images formed on the surfaces of the photosensitive drums 3*a*, 3*b*, 3*c* and 3*d* are performed with high accuracy.

In other words, the resist roller 14 is designed to transfer the sheet so that the front end of images formed on the surfaces of photosensitive drums 3*a*, 3*b*, 3*c* and 3*d* correspond to the front end of the image forming area of the sheet, based on a detection signal output from a sensor switch (not shown) disposed before the resist roller 14.

The fixing unit 12 comprises a heat roller 31, a pressure roller 32 and the like as shown in FIG. 2, wherein the heat roller 31 and the pressure roller 32 are disposed so as to sandwich the sheet (recording paper) and rotate in the opposite direction.

The heat roller 31 of the fixing unit 12 is controlled to maintain a predetermined fixing temperature based on the temperature sensed through a machine controller (control unit) (not shown), and by thermo compressing the sheet together with the pressure roller 32, the color toner image (multicolored toner image) transferred onto the sheet is melted, mixed and pressurized, thereby being heat-fused onto the sheet.

The sheet having completed the fusing process of the color toner image (multicolored image) via the fixing unit 12 is then transferred onto a rotating ejection path of the sheet transfer path S by the transfer roller 25, and discharged onto the eject tray 15 in a reversed position where the color toner image (multicolored image) is faced down.

Figure 3:
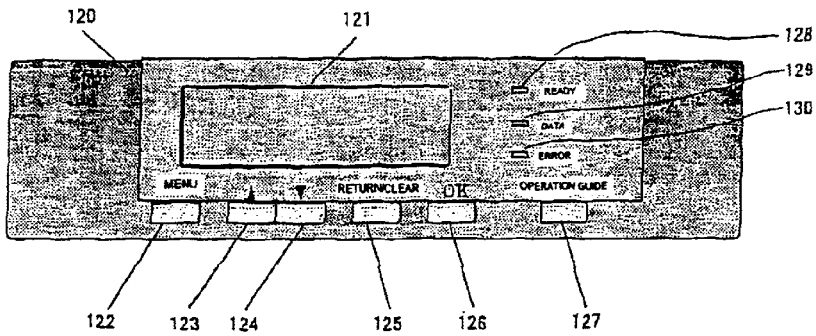
FIG. 3 is a detailed view showing the operating panel of the image forming device in the image processing system according to the preferred embodiment of the invention.

FIG. 3 is a detailed view illustrating the operating panel 120 of the image forming device 100 according to the image processing system of the present embodiment.

As shown in FIG. 3, the operating panel 120 disposed on the body of the image forming device 100 comprises an operating screen 121 which enables the user to confirm various setup statuses of the image forming device 100. The operating panel 120 further comprises in the area below the operating screen 121 a "menu" key 122, an "up (A)" key 123, a "down (V)" key 124, a "return/clear" key 125, an "OK" key 126, and an "operation guide" key 127.

Various settings of the image forming device 100 can be controlled through the operating panel 120.

Further, on the right side of the operating screen 121 of the operating panel 120 are disposed a "ready" LED 128, a "data" LED 129, and an "error" LED 130.

When the "menu" key 122 of the operating panel 120 is pressed, the menu for setting up various conditions for forming an image through the image forming device 100 is displayed on the operating screen 121, by which various conditions can be set up.

The "up" key 123 and the "down" key 124 of the operating panel 120 are for scrolling the contents of the displayed menu since not all the various menus can be displayed at once on the operating screen 121. The user can press either the "up" key 123 or the "down" key 124 until the desired menu information is displayed on the operating screen 121.

The "return/clear" key 125 of the operating panel 120 is for clearing the conditions being varied and to return to the screen prior to the setup of conditions.

The "OK" key 126 of the operating panel 120 is for determining the conditions being varied or set up.

The "operation guide" key 127 of the operating panel 120 is pressed when the user requires an operation guidance for example when a sheet is stuck in the image forming device 100 or when consumable parts must be exchanged. When the user operates the "operation guide" key 127, a message guidance corresponding to the present status of the image forming device 100 is displayed on the operating screen 121 of the operating panel 120.

Next, the LEDS 128, 129, 130 disposed on the right side of the operating screen 121 of the operating panel 120 on the image forming device 100 will be explained.

The "ready" LED 128 of the operating panel 120 of the image forming device 100 is turned on when the image forming device 100 is capable of operating normally, and turned off when the image forming device 100 is in a state where images cannot be recorded.

Thus, the operating status of the image forming device 100 is notified to the user.

Next, the "data" LED 129 of the operating panel 120 is for displaying the status of communication with the outside image transmission device 101, according to which the "data" LED 129 is turned on when communication with the outside device is possible, and blinks when image data is being transmitted from the outside device.

Lastly, the "error" LED 130 of the operating panel 120 is normally turned off, and turns on when the image forming device 100 is in a status where an image forming operation cannot be continued, such as when toner is used up, no recording paper is available, or when paper is stuck in the image forming device 100.

FIG. 4 is a detailed view showing the operation directing screen of the display unit 103 of the image transmission device 101 according to the image processing system of the present embodiment.

On the display screen 103*a* of the display 103 of the image transmission device 101, the driver screen 104*a* is displayed as a window, the driver screen 104*a* being an operation directing screen of the driver 104 comprising operation directing keys for setting up various conditions for transmitting the image data to the image forming device 100, or a button key for starting transmission of the image data, as shown in FIG. 4. The transmission of image data to the image forming device 100 is performed through the driver 104 which is displayed on the window of the driver screen 104*a* on the screen 103*a* of the display 103 of the image transmission device 101.

As shown in FIG. 4, the driver screen window 104*a* of the driver 104 comprises a "sheet size" key 105 for setting up the sheet sizes of the recording member such as A3, B4, A4, B5 sizes; a "sheet type" key 106 for setting up the sheet type indicating the material or weight of the recording member such as a normal paper, a thick paper, an OHP sheet, an envelope, or a special paper; a "print direction" key 107 for setting up the direction of print on the recording member (vertical direction or horizontal direction); a "scale" key 108 for setting up the recording scale; a "ruled line" check box 109 for setting up whether there is a boundary line determined by a ruled line; a "marginless printing" check box 110 for setting up whether to validate marginless printing mode or not; a "print" key 111; and a "cancel" key 112.

According to this driver screen (operation directing screen) 104*a* of the driver 104, it is possible to set up various conditions such as the sheet size indicating the size of the printing material such as A3, B4, A4 and B5, the sheet type defining the material or weight and the like of the sheet such as normal paper, thick paper, OHP sheet, envelope and special paper, the direction of printing on the recording member (vertical or horizontal), and the recording scale.

The user can click the "sheet size" key 105 on the driver screen 104*a* of the driver 104 to set up the sheet size of the recording member such as A3, B4, A4 and B5 sizes.

The user can click the "sheet type" key 106 on the driver screen 104*a* of the driver 104 to set up the sheet type of the recording member defining the material and weight of the member, such as normal paper, thick paper, OHP sheet, envelope and special paper.

Further, the user can click the "print direction" key 107 on the driver screen 104*a* to set up the direction of printing (vertical or horizontal) on the recording member.

Moreover, the user can click the "scale" key 108 on the driver screen 104*a* to set up the recording scale.

Usually, in the driver screen 104*a* of the driver 104, a certain preset default value (general value frequently utilized) is set up, and the user does not need to set up all the various setup items on the driver screen 104*a* for the appropriate image to be printed out.

However, if necessary, the user can designate various setup portions by clicking the setup portions on the driver screen 104*a* and to change the contents of various setup conditions.

The driver screen 104*a* further comprises check boxes, such as the "ruled line" check box 109 for setting up whether there is a border line defined by a ruled line, and the "marginless printing" check box 110 for setting up whether to validate the marginless printing mode according to the present embodiment.

The "print" key 111 on the driver screen 104*a* functions as a trigger key for actually transmitting the image data from the image transmission device 101 to the image forming device 100 and to execute printing.

The "cancel" key 112 of the driver screen 104*a* is for canceling the print execution and to close the driver screen 104*a* of the driver 104.

Now, the method for selecting the marginless printing mode according to the image forming device 100 of the present image processing system will be explained in detail.

Figure 5:
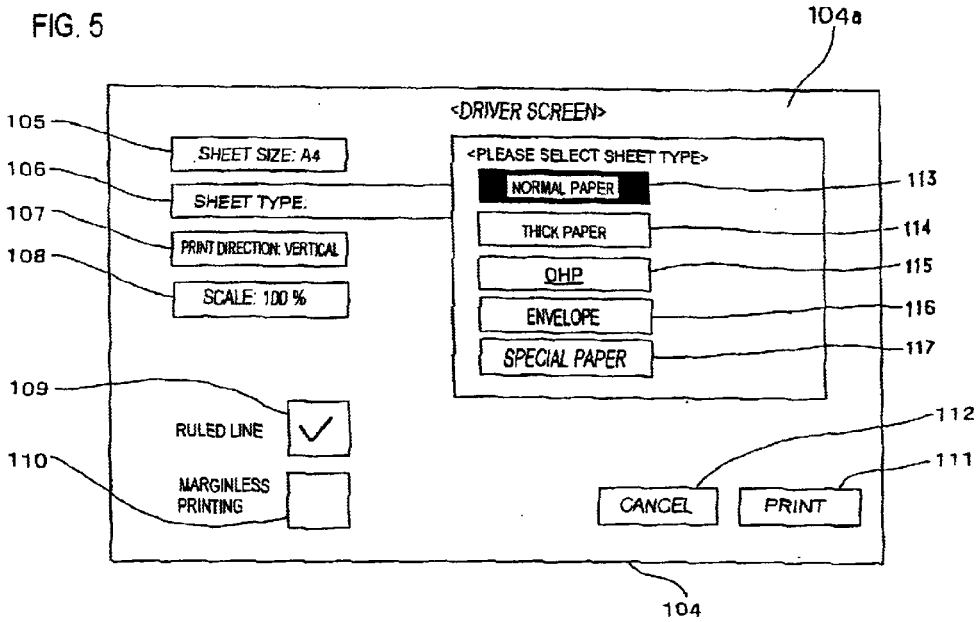
FIG. 5 is a view showing one example of a screen for selecting the paper type from a driver screen of a driver of the image transmission device in a normal printing mode in the image forming device of the image processing system with regard to the present invention.

FIG. 5 is a drawing showing one example of the driver screen 104*a* for selecting the sheet type from the driver screen 104*a* of the driver 104 of the image transmission device 101 during a normal printing mode of the image forming device 100.

According to the driver screen 104*a* of the driver 104, when the user clicks the "sheet type" key 106, there is displayed on the driver screen 104*a* a "normal paper" key 113, a "thick paper" key 114, an "OHP" key 115, an "envelope" key 116, and a "special paper" key 117 enabling the user to select sheet types, as shown in FIG. 5.

Next, when the user selects the "normal paper" key 113 in the driver screen 104*a*, the selected "normal paper" key 113 is displayed in white letters (inverse video) on the driver screen 104*a* as shown in FIG. 5, according to which the user can confirm the determined status of the sheet type.

The device to which the present embodiment is applied is an image forming device utilizing an electrophotographic process and a heat fixing roller.

Therefore, only recording members that have a certain degree of toughness that can be removed smoothly from the fixing device and ejected are capable of being selected to record images on the whole area of the recording member.

For example, the sheet types allowing images to be recorded on the whole area of the sheet are thick paper, OHP sheets, envelopes, special paper, postcards, business cards and the like. Only when the sheet types of the recording member that satisfy these conditions are selected in the "sheet type" key 106 of the driver screen 104*a* will the "marginless printing" check box 110 enabling the user to select the marginless printing mode be displayed on the driver screen 104*a*.

In FIGS. 4 and 5, the "marginless printing" check box 110 is shown on the driver screen 104*a* of the driver 104 only to show that a column for selecting a "marginless printing mode" exists in the driver 104.

In actual use, since according to FIGS. 4 and 5 the selected sheet type is "normal paper", the "marginless printing" check box 110 for selecting the marginless printing mode is not displayed on the driver screen 104*a* of the driver 104.

Figure 6:
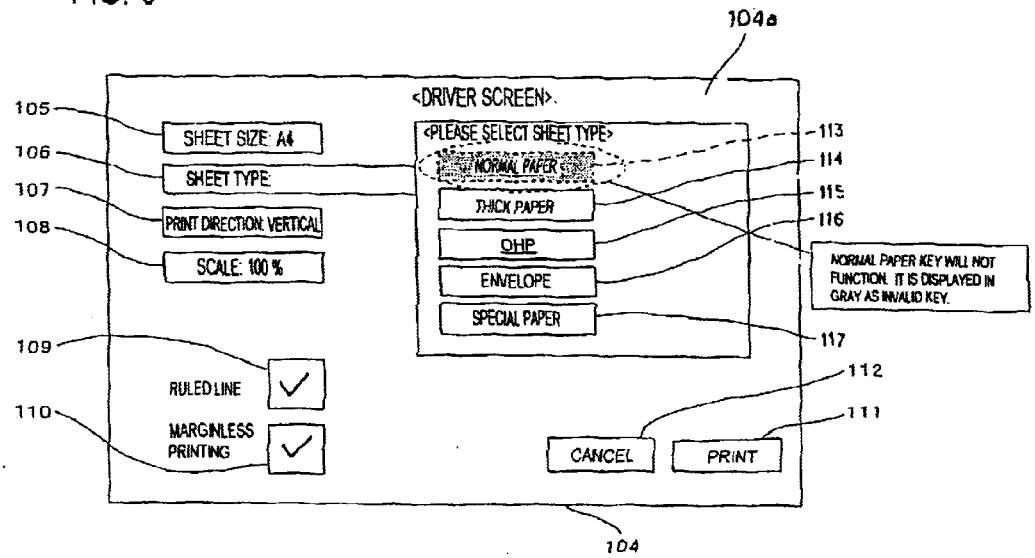
FIG. 6 is a view showing one example of a screen for selecting the paper type from a driver screen of a driver of the image transmission device in a marginless printing mode in the image forming device of the image processing system with regard to the present invention.

FIG. 6 is a drawing showing one example of a driver screen 104*a* for selecting the sheet type from the driver screen 104*a* of the driver 104 of the image transmission device 101 when a marginless printing mode is selected for the image forming device 100 of the present image processing system.

When the user clicks the "sheet type" key 106 in the driver screen 104*a* of the driver 104, the driver screen 104*a* of the driver 104 displays, as shown in FIG. 6, "normal paper" key 113, "thick paper" key 114, "OHP" key 115, "envelope" key 116 and "special paper" key 117.

Next, when the user selects and clicks one key out of the "thick paper" key 114, "OHP" key 115, "envelope" key 116 and "special paper" key 117 in the driver screen 104*a*, the selected key is displayed (not shown) in white letters (inverse video) on the screen, and the "marginless printing" check box 110 for selecting the marginless printing mode is displayed on the driver screen 104*a*, as shown in FIG. 6.

Thereafter, when the user clicks the "marginless printing" check box 110 in the driver screen 104*a*, the marginless printing mode is made effective, and the "normal paper" key 113 of the driver screen 104*a* becomes invalid, by which the paper types that can be selected by the "sheet type" key 106 is determined.

Furthermore, as shown in FIG. 4, if the "marginless printing" check box 110 is displayed in advance on the driver screen 104*a* and the user clicks the "marginless printing" check box 110 to enter a check mark thereto, it is possible to display only the selectable sheet types in the marginless printing mode to the driver screen 104*a* of the driver 104.

In the above configuration, it is possible to set up in advance the possible options of the sheet types of the recording member in a marginless printing mode per each user from the operation panel 120 of the image forming device 100.

Furthermore, the image forming device 100 can determine whether the determined sheet type of the recording member corresponds to the sheet type enabling marginless printing, and the image forming device 100 can send out the information on the predetermined sheet type information that it holds to the driver 104 according to the request for sheet type information received from the driver 104.

Thus, the driver 104 is capable of judging whether such marginless printing is possible or not.

Figure 7:
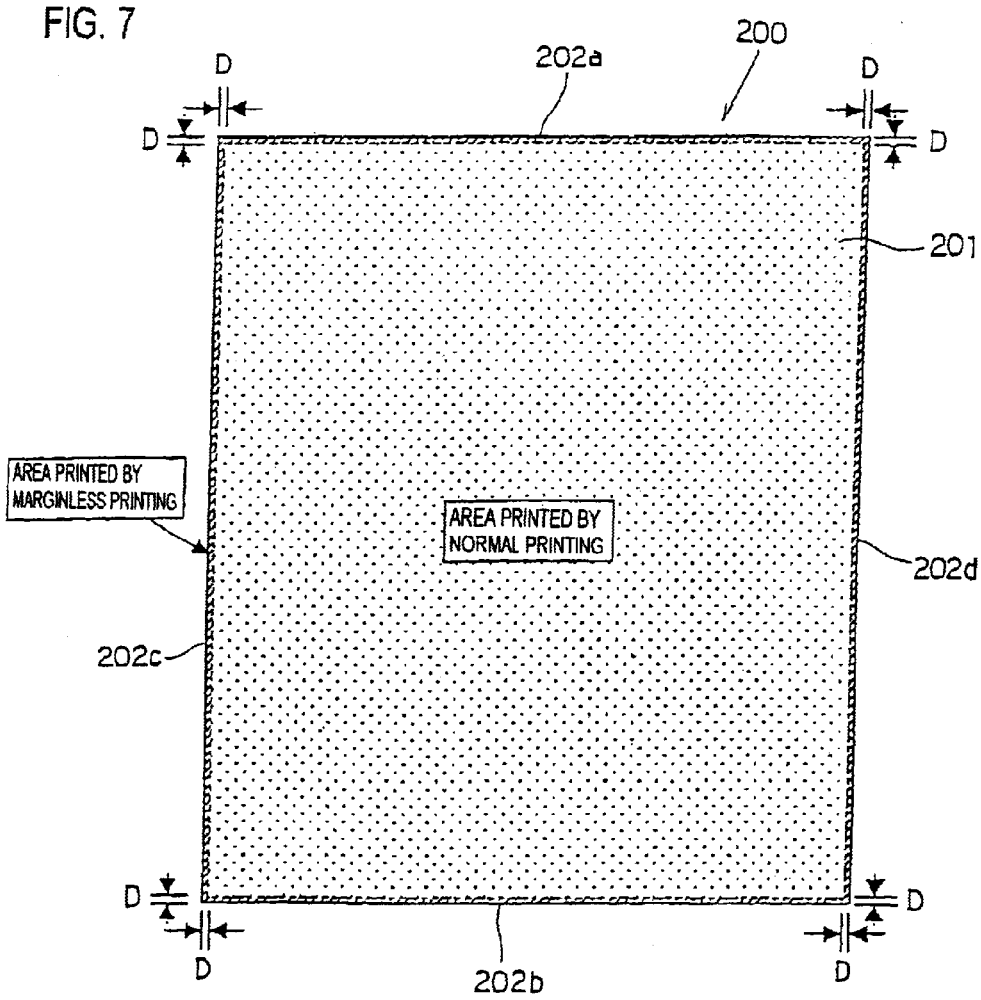
FIG. 7 is an explanatory view showing the printing areas of a recording member printed according to the marginless printing mode and the normal printing mode by the image forming device of the image processing system with regard to the present invention.

Next, FIG. 7 is used to explain an image area of a recording paper 200 that is utilized as a recording member for actually printing an image using the image forming device 100 based on the above-explained operation.

FIG. 7 is an explanatory view showing the printing areas of the recording member based on a marginless printing mode and a normal printing mode, capable of being printed through the image forming device 100 of the image processing system according to the present embodiment.

According to the normal printing mode of the image forming device 100, as shown in FIG. 7, an image is printed only on a printing area of a normal area 201 in which an image corresponding to a predetermined area, which in this case is width D, is removed from both front and rear ends 202*a* and 202*b* and both side ends 202*c* and 202*d*, in any arbitrary sheet size of the recording paper 200.

According to the marginless printing mode of the image forming device 100, as shown in FIG. 7, an image is printed to the whole area of the recording paper 200 having an arbitrary sheet size, with printing performed to correspond also to the printing area corresponding to the predetermined area of width D from both front and rear ends 202*a* and 202*b* and both side ends 202*c* and 202*d*, the area which had been eliminated according to the normal printing mode.

According to the marginless printing mode, it is also possible to set a printing condition so that the image formed to the predetermined area of the recording paper has a somewhat reduced printing density (amount of developer being adhered) than the image formed to the normal area of the normal printing mode excluding the predetermined area.

This is because since the recording paper is somewhat tough and thick, there is a possibility that the non-fixed image is displaced at the edge portions of the recording paper during the transfer step, by which the quality of the image being formed on the recording paper maybe deteriorated. Therefore, the image formed on the predetermined area of the sheet may have a reduced density (smaller amount of developer being adhered) compared to the image formed on the normal area.

Furthermore, the present embodiment adopts an image forming device utilizing an electrophotograhic process (LED printer), but other image forming devices, such as a digital copying machine with a scanner, or an image forming device having other types of recording units such as an inkjet printer or a thermal printer, can also be adopted.

If an inkjet printer is used to perform the marginless printing mode in which the whole area of the recording paper including its edges is used to print an image with a developer or an ink, the recording paper may be deflected or curved, which may cause the driven ink carriage to collide against the edge of the deflected paper and rip the paper, or may cause ink to be blurred. Thus, the relation between the types of recording papers and the marginless printing mode can be selected accordingly.

As explained, according to the present image processing system, the image forming control means of the image transmission device 101 enables an image to be formed on the whole area of the recording member corresponding to the first image forming mode of the image forming device 100 according to the feature/type of recording member being used, so the image can be recorded effectively and advantageously to the whole area of a specific feature/type of recording member such as thick paper, OHP sheets, envelopes, special paper, postcards, or business cards.

Furthermore, it is possible to set in advance a recording member that is not preferable for recording an image on the whole area thereof using a developer or an ink, so accordingly, it becomes possible to prevent the recording member from being deflected or curved by not performing unreasonable image forming. According to the present image processing system, simply by selecting via the recording member selecting means of the image transmission device 101 the recording material for recording the image, the image forming mode control means of the image transmission device 101 enables the first image forming mode (in which an image is formed to the whole area of the recording member) of the image forming device 100 to be selectable only when the selected recording member is suitable for carrying out the whole area recording, according to the feature of the recording member being selected. Therefore, the user will not be confused because if the selected recording member is not suited for whole area recording, the first image forming mode will not appear on the screen as an option.

When a recording member capable of marginless printing is selected by the recording member selecting means of the image transmission device 101, a first image forming mode of the image forming device 100 becomes effective as one option, facilitating use by the user.

According to the present image processing system, simply by selecting either a first image forming mode or a second image forming mode of the image forming device 100 through an image forming mode selecting means of the image transmission device 101, the recording member determining means of the image transmission device 101 determines recording members that are appropriate for the selected first or second image forming mode, so the user simply needs to select and indicate the desired recording member out of the determined recording members determined as option by the recording member determining means of the image transmission device 101. The user will not be confused because the recording members not suited for whole area printing are not displayed as options from the start.

According to the present image processing system, the thickness of the recording member body is set as the feature/type of the recording members, so the recording members such as a thick paper, an OHP sheet, an envelope, a special paper, a postcard or a business card having a specific feature/type (thickness) can be subjected to effective image forming, since these members can be transmitted in the image forming device 100 and ejected to the outside of the image forming device 100 without being adhered to the photosensitive drum or fixing roller.

Moreover, since an image can be recorded on the whole area of the recording member of a specific feature/type, the image can be recorded effectively on the recording member, by which the user benefits.

According further to the present image processing system, upon forming an image to the whole area of the recording member of a specific feature/type based on a first image forming mode of the image forming device 100, the density of the image being formed on the predetermined area (rim area) of the recording member is suppressed more than the density of the image formed to the normal area of the recording member. Since the amount of developer adhered to the predetermined rim area of the recording member is smaller than the amount of developer adhered to the normal area of the recording member, the image formed on the recording member will not be deteriorated, and image data can be reproduced with high accuracy on the recording member.

According to a method for recording an image of the present invention, an image is reproduced on the whole area of the recording member having a specific feature in the image reproducing step, and the reproduced image on the whole area of the recording member having a specific feature is fixed in the image fixing step. In the image forming device 100 utilizing an electrophotographic process, the recording member of a specific feature (thickness) such as a thick paper, an OHP sheet, an envelope, a special paper, a postcard and a business card can be transferred and ejected from the image forming device 100 without being adhered to a photosensitive drum or a fixing roller, by which very effective image recording is made possible.

What is claimed is:

1. An image processing system comprising an image forming device for forming an image on a recording member, and an image transmission device connected to the image forming device for transmitting an image data to the image forming device, wherein:

the image forming device comprises a function for forming the image according to a first image forming mode in which the image is formed to a whole area of a recording member, and a function for forming the image according to a second image forming mode in which the image is formed to a normal area of the recording member excluding a specific area thereof; and the image transmission device comprises an image forming control unit that enables the image to be performed to the whole area of the recording member based on the first image forming mode of the image forming device according to a feature/type of the recording member used to record the image.

2. An image processing system according to claim 1, wherein the image transmission device comprises a recording member selecting unit for selecting the recording member for recording the image, and an image forming mode control unit for making the first image forming mode of the image forming device in which the image is formed to the whole area of the recording member selectable according to the feature/type of the recording member being selected via the recording member selecting unit.

3. An image processing system according to claim 2, wherein the image transmission device comprises an image forming mode selecting unit for selecting either the first image forming mode or the second image forming mode of the image forming device, and a recording member determining unit for determining the recording members capable of being selected by the recording member selecting unit according to the first image forming mode or the second image forming mode of the image forming device selected by the image forming mode selecting unit.

4. An image processing system according to claim 1, wherein the feature/type of the recording member refers to a thickness of a recording member body of the recording member.

5. An image processing system according to claim 1, wherein the image forming device comprises a function of suppressing a concentration of the image formed to the specific area at a rim portion of the recording member more than a concentration of the image formed to the normal area of the recording member excluding the specific area at the rim portion thereof, when forming the image to the whole area of the recording member of the feature/type according to the first image forming mode.

6. A method for recording an image to a whole area of a recording member of a specific feature/type utilizing an electrophotographic process, wherein the method comprises:

an image reproducing step of reproducing the image on the whole area of the recording member of the specific feature/type; and an image fixing step of fixing the image reproduced on the whole area of the recording member of the specific feature/type.

* * * * *